US006033062A

United States Patent [19]

Hotomi

[11] Patent Number: 6,033,062

[45] Date of Patent: Mar. 7, 2000

[54] INK CARTRIDGE AND A CONNECTION MECHANISM OF AN INK CARTRIDGE

[75] Inventor: Hideo Hotomi, Nishinomiya, Japan

[73] Assignee: Minolta Co., Ltd., Osaka, Japan

[21] Appl. No.: 09/083,490

[22] Filed: May 22, 1998

[30] Foreign Application Priority Data

May 27, 1997 [JP] Japan ..... 9-136939

[51] Int. Cl.[7] ..... B41J 2/175

[52] U.S. Cl. ..... 347/86

[58] Field of Search ..... 347/85, 86

[56] References Cited

U.S. PATENT DOCUMENTS 5,821,965 10/1998 Oda et al. ..... 347/86

FOREIGN PATENT DOCUMENTS 7-89087 4/1995 Japan .

7-331195 12/1995 Japan .

*Primary Examiner*—Huan Tran
*Assistant Examiner*—Michael Nghiem
*Attorney, Agent, or Firm*—Sidley & Austin

[57] ABSTRACT

The ink supplying port of the ink cartridge is shielded by an elastic film having a plurality of holes of a size that ink cannot pass therethrough without extending the film. On the ink cartridge connecting portion, a pressure member is provided which, under the condition that the ink supplying port is attached to the ink cartridge connecting portion, pressurizes and extends the elastic film to enlarge the holes to the size that ink is able to pass therethrough and to supply the ink in the ink cartridge to the ink cartridge connecting portion. With such an arrangement, when the ink cartridge is accommodated in the accommodating space of the carriage, the elastic film is pressurized by the pressure member to supply ink. In a state that the ink cartridge is detached, the elastic film is not extended, and thus permeation of ink is prevented.

19 Claims, 7 Drawing Sheets

FIG. 5
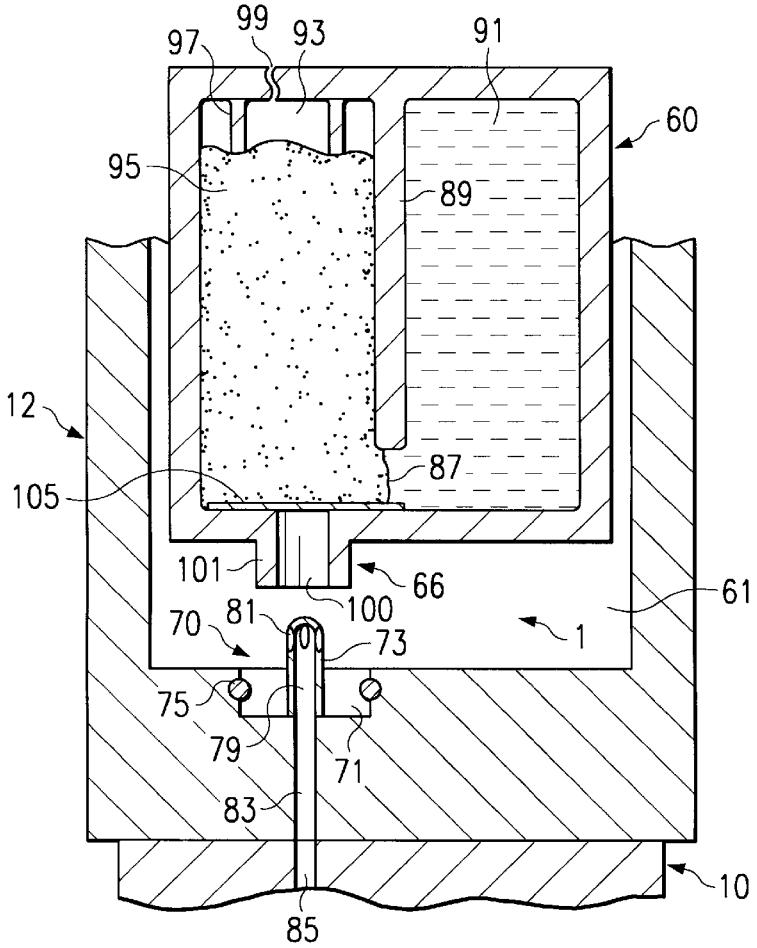
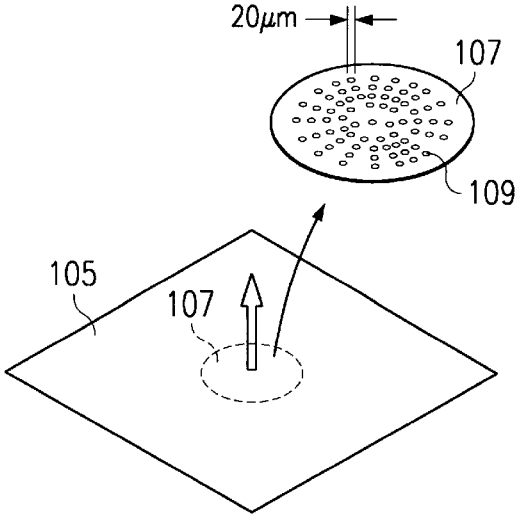
FIG. 6A
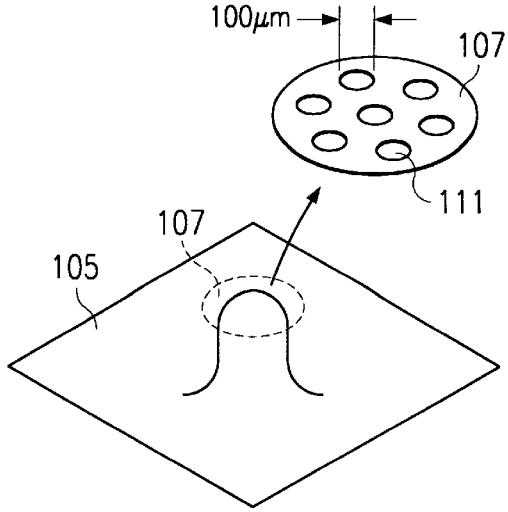
FIG. 6B

INK CARTRIDGE AND A CONNECTION MECHANISM OF AN INK CARTRIDGE

This application is based on application No. Hei 9-136939 filed in Japan, the content of which is hereby incorporated by reference.

BACKGROUND OF THE INVENTION

1. Field Of The Invention

The present invention relates to an ink cartridge accommodating ink and an ink cartridge connection mechanism for an ink jet recording apparatus which forms an image on a recording medium by jetting ink drops in accordance with image information.

2. Description of the Related Art

Conventionally, an ink jet recording apparatus has been used which supplies ink to a cavity of an ink jet recording head having, for example, a piezoelectric element as pressure means and pressurizes the ink accommodated in the cavity by driving the aforesaid piezoelectric element to jet the ink from a nozzle connected with the cavity and to form an image on a recording medium.

Supplying ink to the aforesaid ink jet recording apparatus is performed, as shown in FIG. 11, by connecting an ink cartridge 205 accommodating ink with an ink cartridge accommodating portion 203 which is provided in a carriage 201 retaining an ink jet recording head 200.

The aforesaid ink cartridge 205 has a box-shaped main body. The upper part of the inside thereof is divided into an ink accommodating section 209 and a filler accommodating section 211 by a partition plate 207. In the filler accommodating section 211, a filler 213 made of porous material is accommodated. This filler 213 is fixed by ribs 215 and 217 which are provided on an internal ceiling part and a floor part, respectively. A venthole 219 is formed in the ceiling part of the filler accommodating section 211, and an ink supplying port 221 is formed in the floor part. At the outlet of the ink supplying port 221, formed is a cylindrical shaped pressure pin inserting portion 223.

Ink is accommodated in the ink accommodating section 209 and permeates into the filler 213 at a connection part 225 which is positioned at the lower edge portion of the partition plate 207 and connects the ink accommodating section 209 and the filler accommodating section 211.

In the ink cartridge accommodating portion 203, a concave portion 227 accommodates the aforesaid pressure pin inserting portion 223. On the bottom part of this concave portion 227, a pressure pin 229 is protrusively provided. The pressure pin 229 is inserted into the pressure pin inserting portion 223 when the pressure pin inserting portion 223 is accommodated in the concave portion 227. On the edge of the concave portion 227, an O-shaped ring 231 is attached to gaplessly connect the concave portion 227 with the pressure pin inserting portion 223. The tip of the pressure pin 229 is pointed so as to stick into the filler 213, and an ink inlet 235 is formed which is connected with an ink path 233 formed inside the pressure pin 229. The aforesaid ink path 233 is connected with an ink supplying path 237 of the ink jet recording head 200.

When the ink cartridge 205 arranged as described above is connected with the ink cartridge accommodating portion 203, the pressure pin 229 is inserted into the pressure pin inserting portion 223 and the tip thereof sticks into the filler 213, thereby the ink permeated in the filler 213 enters through the ink inlet 235 and is supplied to the ink jet recording head 200 through the ink path 233 and the ink supplying path 237.

However, according to the ink cartridge 205 having the aforesaid arrangement, since ink permeates into the filler 213 not only in the case that ink is left inside the ink accommodating section 209 but also in the case that the ink otherwise accommodated in the ink accommodating section 209 is exhausted, such a problem occurs wherein ink leaks from the ink supplying port 221 in exchanging the ink cartridge 205. If an openable lid (not shown) is provided over the ink supplying port 221 to prevent the leakage of ink, the problem is caused that the open and close mechanism of the lid causes increase of producing cost of ink cartridges.

Further, when the pressure pin 229 penetrates to the filler 213, both ink and including air may enter the ink inlet 235. If the ink including air in this way is supplied to the ink jet recording head 200, this air becomes bubbles to act as a damper inside an ink pressure section (cavity) for pressurizing ink and the pressurization of ink is disturbed, thereby desired ink drops cannot be formed and discharged from ink jet recording head 200. Accordingly, the problem is present that known ink jet recording apparatuses are not able to form excellent images in some cases.

SUMMARY OR THE INVENTION

The present invention is accomplished to solve the aforesaid problems, and aims to certainly supply the ink in an ink cartridge to an ink jet recording apparatus without increasing cost and to form excellent images.

To accomplish the aforesaid objects, the present invention provides an ink cartridge accommodating ink and having an ink supplying port which supplies the ink outside the ink cartridge and an elastic film which is arranged at a position for covering said ink supplying port, where such film has a plurality of small holes.

The connection mechanism of the ink cartridge of the present invention is a connection mechanism between an ink cartridge accommodating portion and an ink cartridge accommodating ink therein, where the connection mechanism comprises an ink supplying port formed on the ink cartridge; an elastic film having a plurality of small holes and elasticity and provided at a position for covering said ink supplying port; and a pressure portion which pressurizes said elastic film in the state that said ink cartridge is accommodated in said ink cartridge accommodating portion.

These and other object, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 5 is a cross sectional view showing the state that the ink cartridge is connected with an ink cartridge connecting portion;

FIG. 6A is a perspective view of an elastic film;

FIG. 6B is a perspective view showing an extended elastic film:

DESCRIPTION OF THE PREFERRED EMBODIMENTS

Figure 1:
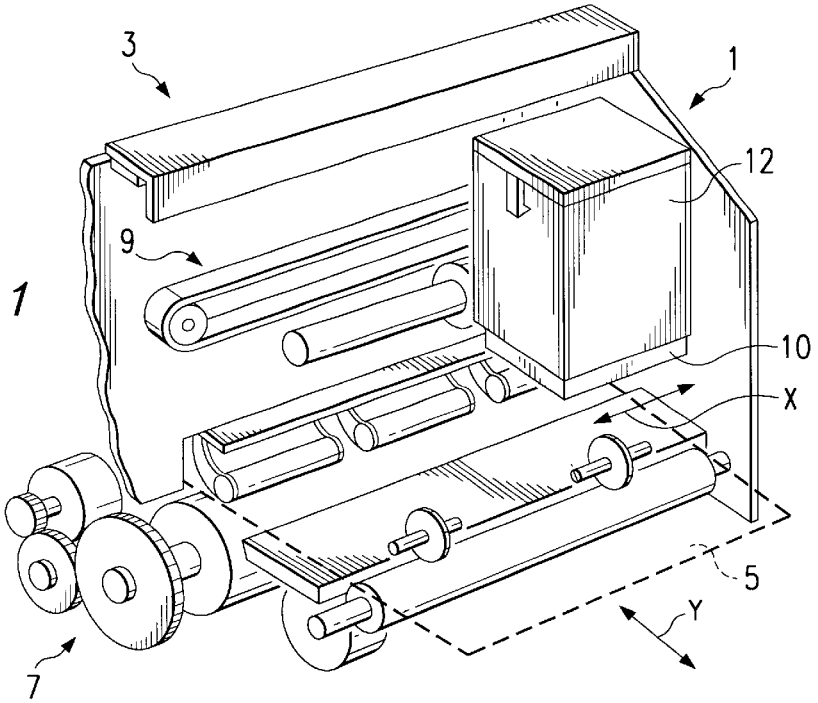
FIG. 1 is a partial perspective view of an ink jet printer having an ink cartridge connection mechanism for an ink jet recording apparatus of an embodiment of the present iinvention.

Embodiments of the present invention is described below referring to the attached drawings. FIG. 1 is an ink jet recording apparatus 3 having an ink cartridge connection mechanism 1 for an ink jet recording apparatus of an embodiment of the present invention. The ink jet recording apparatus 3 has a forwarding mechanism 7 for sending out a paper sheet 5 as a recording medium in a sub scanning direction (in the direction shown by arrow y) and a moving mechanism 9 for moving a carriage 12 in a main scanning direction (in the direction shown by arrow x). An ink jet recording head (refer to "recording head", hereinafter) 10 is movable in the main scanning direction (direction x) by being attached to the carriage 12.

Figure 2:
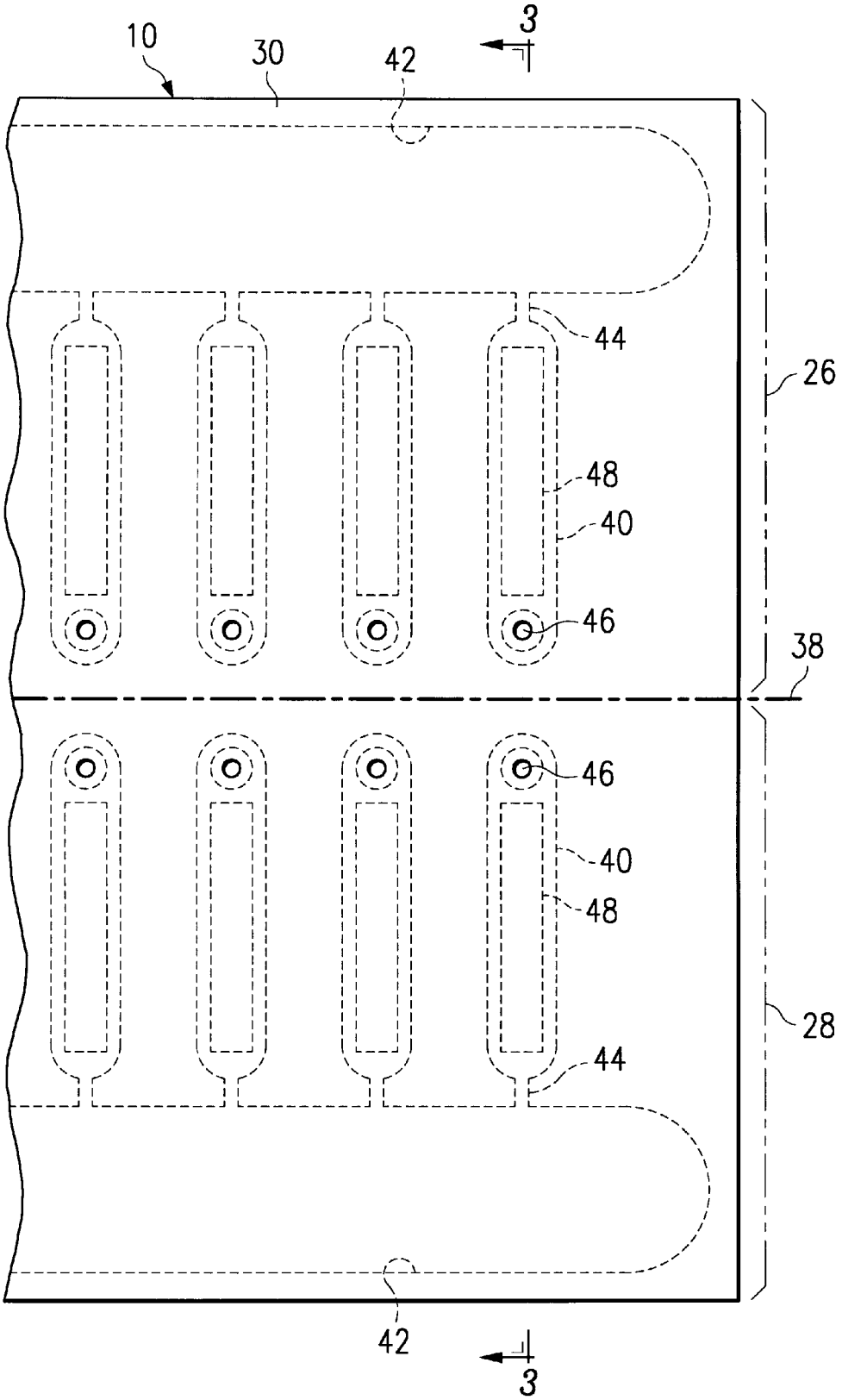
FIG. 2 is a partial plan view of an ink jet recording head.
Figure 3:
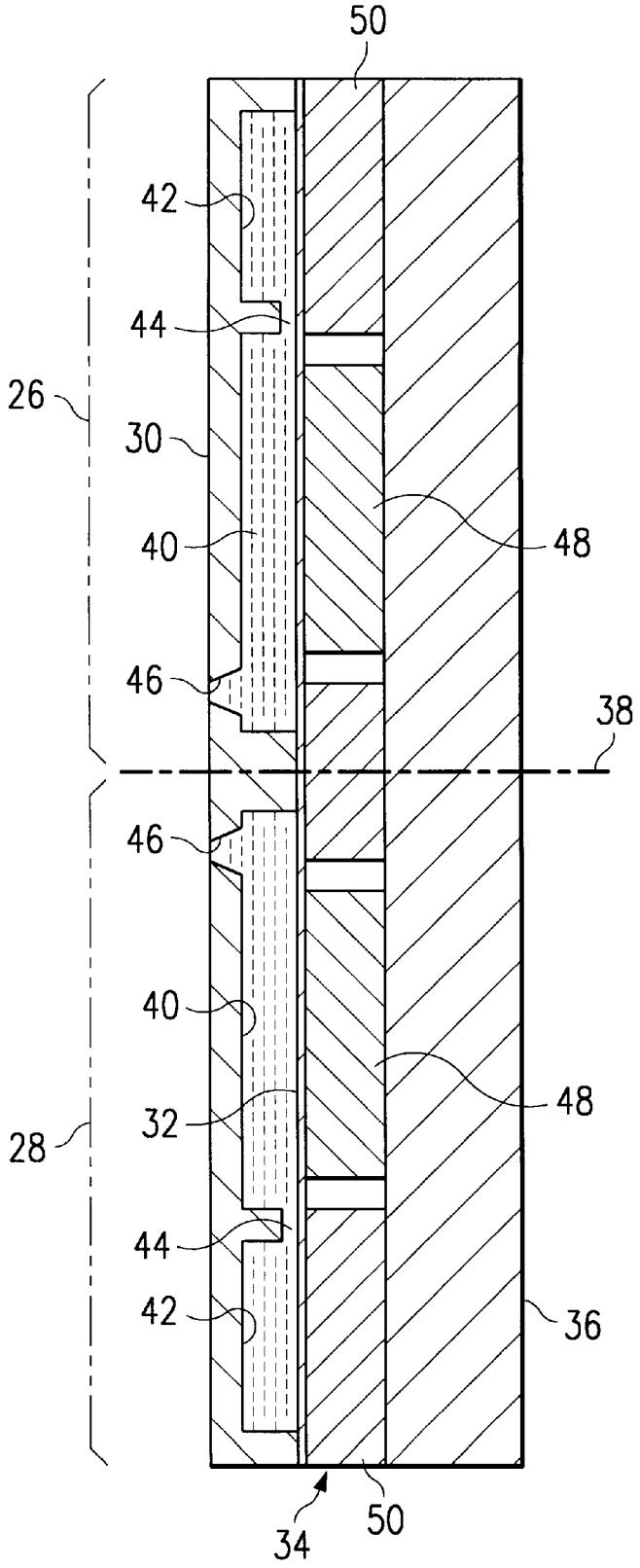
FIG. 3 is a cross sectional view taken on line III—III of the ink jet recording head shown in FIG. 2.

FIG. 2 and FIG. 3 show a front of the recording head 10 and a section taken on line III—III of FIG. 2, respectively. As shown in these drawings, the recording head 10 has a first recording head portion 26 and a second recording head portion 28, and is arranged by integrating a top plate 30, a septum 32, a vibration plate 34 and a base plate 36 as a unit. The first recording head portion 26 and the second recording head portion 28 are aligned in the direction of movement of the recording head 10 and are symmetric with respect to the central chain line 38.

The top plate 30 is formed a plurality of concave portions by performing microprocessing to a surface facing the septum 32 by way of electroforming, photolithography or the like. In each of the first recording head portion 26 and the second recording head portion 28, an ink supplying section 42 are formed for accommodating an ink for supply, a plurality of cavities 40 for accommodating the ink to be jetted from a nozzle 46 and a plurality of inklets 44 for connecting each cavity 40 with the ink supplying section 42.

The ink supplying sections 42 of the first recording head portion 26 and the second recording head portion 28 are parallel to each other. The cavities 40 are formed like grooves which extend parallel to one another from the ink supplying section 42 toward a part where the recording head portions 26 and 28 face each other. On the top plate 30, a plurality of nozzles 46 are formed which are connected with the cavities 40 at the side opposite to the inklets 44 on a line vertical to the longitudinal direction of the cavities 40 at predetermined intervals. The nozzles 46 are shaped like a taper which becomes thinner toward the outside, and the inside diameter at the outlet is 25 $\mu$m.

The septum 32 is formed by a thin film made of a conductive member and is fixed between the top plate 30 and the vibration plate 34. It is to be noted that this septum never disturbs transformation of a piezoelectric member 48 described later, and is transformed in accordance with transformation of the piezoelectric member 48.

The vibration plate 34 is provides a conductive layer, for example, by the method that metal is evaporated on an upper surface and a lower surface of a ceramic plate, and fixed to the septum 32 and the base plate 36 by conductive adhesive. After being adhesively fixed to the base plate 36, the vibration plate 34 is cut lengthwise and crosswise by a dicing process and separated into piezoelectric members 48 facing the cavities 40 and walls 50 surrounding each piezoelectric member 48. Each piezoelectric member 48 is performed the poling process by applying high pressure under a high temperature.

The base plate 36 provides a plurality of conductive lead portions (not shown) on the surface facing the vibration plate 34, and each conductive lead portion faces the piezoelectric member 48.

According to the recording head 10 having the above-mentioned arrangement, when ink is supplied to the ink supplying section 42 from an ink cartridge 60 (described later) through an ink cartridge connection portion 70 in each recording head portion 26 and 28, the ink in the ink supplying section 42 is distributed to each cavity 40 via ink inlets 44. It is to be noted that the arrangement of the recording head 10 is not limited to be the described arrangement of first recording head portion 26 and the second recording head portion 28; rather, such may be arranged only by the first recording head portion 26. Further, the nozzles 46 of the first recording head portion 26 and the second recording head portion 28 are not limited to a parallel arangement double lines, rather, such may be arranged in a zigzag pattern or in a plurality of lines.

According to the ink jet recording apparatus 3 having the above-mentioned arrangement, the piezoelectric member 48 receives a predetermined voltage (printing signal) to be transformed toward the cavity 40. By transmitting the transformation to the septum 32 and pressurizing the ink in the cavity 40, ink drops are discharged from the nozzle 46. At this time, the recording head 10 is reciprocated in the main scanning direction (x direction) and the paper sheet 5 is moved in the sub scanning direction (y direction) to form a desired image on the paper sheet 5.

Figure 4A:
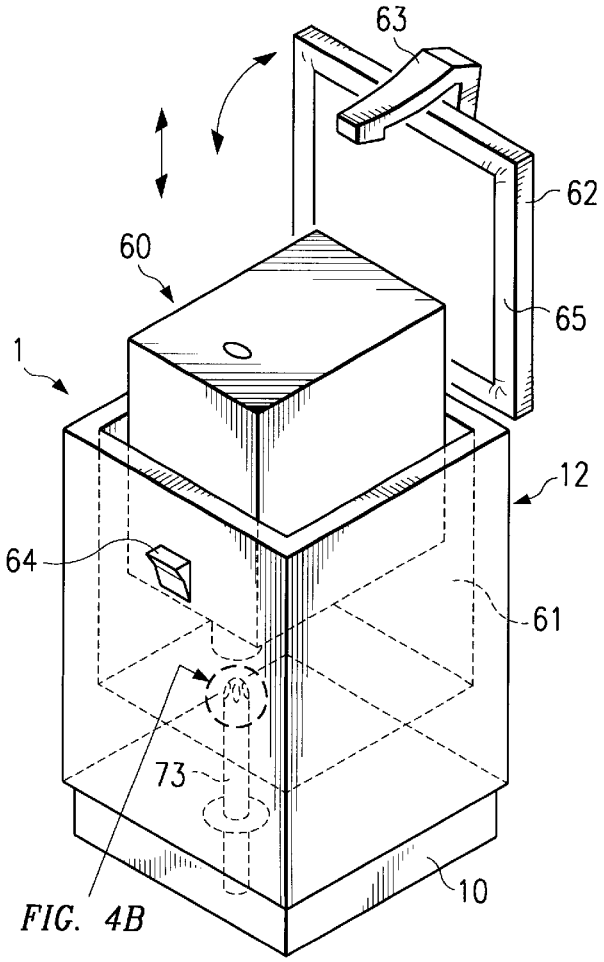
FIG. 4A is a perspective view showing the state that an ink cartridge is accommodated into a carriage.

The description about the ink cartridge connection mechanism 1 is as follows. As shown in FIG. 4A, an accommodating space 61 is formed in a carriage 12 to accommodate an ink cartridge 60. The carriage 12 has an openable lid 62, and in the state that the ink cartridge 60 is accommodated in the accommodating space 61 and the lid 62 is closed, an engaging claw 63 provided on the lid 62 engages with an engaged portion 64 provided on the body of the carriage 12. A rubber pad 65 is attached around the inside of the lid 62 so that the lid 62 closely contacts with the carriage body.

As shown in FIG. 5, on the bottom surface of the accommodating space 61, an ink cartridge connecting portion 70 is provided which is connected with an ink supplying port 66 of the ink cartridge 60. This ink cartridge connecting portion 70 has a concave portion 71 for accommodating the ink supplying port 66 and a pressure member 73 provided at the center of the concave portion 71. On the edge of the concave portion 71 an O-shaped ring is attached so as to connect the ink supplying port 66 and the concave portion 71 without a gap.

Figure 4B:
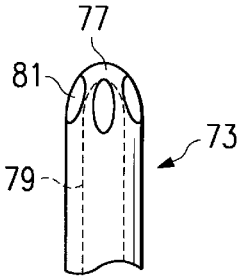
FIG. 4B is a partial enlarged perspective view of a pressure member.

The aforesaid pressure member 73 is described referring to the enlarged view shown in FIG. 4B. The tip portion of a round pole 77 is processed to a hemispherical shape. In the inside, a cutting process is performed to form an ink flowing path 79, and an ink flowing port 81, which has a plurality of elliptical holes connected with the ink flowing path 79, is formed on the tip portion 77. The aforesaid ink flowing path 79 is connected with an ink flowing path 85 which is connected with the ink supplying section 42 of the recording head 10 through an ink flowing path 83 formed in the carriage 12.

Next, a description of the arrangement of the ink cartridge 60 follows referring to FIG. 5. The ink cartridge 60 has a box-shaped main body, and the interior thereof is divided into an ink accommodating section 91 and a filler accommodating section 93 by a partition plate 89 except for a connecting portion 87 on the bottom surface side. A filler 95 made of sponge is accommodated in the filler accommodating section 93 and is fixed by a rib 97 provided on a ceiling part inside the filler accommodating section 93. A vent hole 99 is formed on the ceiling part of the 20 filler accommodating section 93, and the ink supplying port 66 is formed in the bottom part. The ink supplying port 66 has an opening portion 100 through which ink flows out and a cylindrical-shaped pressure member inserting portion 101 protrudently provided outside the opening portion.

Attached on an interior surface of cartridge 60 on a side facing the filler accommodating section 93 of the opening portion 100, an elastic film 105, made of silicon rubber of 100 $\mu$m in thickness to shield the opening portion 100 is provied. The aforesaid elastic film 105 is rectangular-shaped as shown in FIG. 6A. At a facing portion 107 facing the opening portion 100, a plurality of holes 109 are formed, where each hole 109 has a size that ink cannot pass therethrough (about 20 $\mu$m in diameter). In the state that the ink cartridge 60 is attached to the carriage 12, that is, in the state that the ink cartridge 60 is connected with the ink cartridge connecting portion 70, the aforesaid facing portion 107 is extended by being pressurized by the pressure member 73 on the carriage side to transform the holes 109 to holes 111 of the size that ink is able to pass therethrough (about 100 $\mu$m in diameter). The material of the aforesaid elastic film 105 is not limited to silicon rubber and may be a rubber having a predetermined strength, flexibility and elasticity such as fluorosilicon rubber, butadiene rubber, urethane rubber and the like. The diameter and shape of the holes 109 and 111 should be set appropriately based on the ink accommodated in the ink cartridge 60, the material of the elastic film 105, the material of the filler 95 and the like, and they are not limited to the aforesaid sizes.

Ink is accommodated in the ink accommodating section 91 of the ink cartridge 60, and penetrates to the filler 95 via the connection portion 87. Since the opening part 100 is shielded by the elastic film 105, ink never leaks from the opening portion 100 even if the inside of the ink cartridge is arranged by only the ink accommodating section 91.

Figure 7:
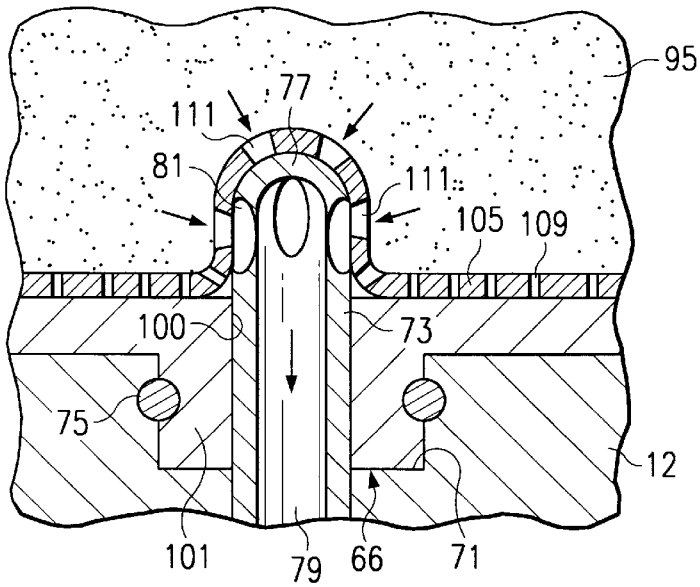
FIG. 7 is a partial cross sectional view showing the state that an ink supplying port is connected with the ink cartridge connecting portion.

According to the ink cartridge connection mechanism 1 having the aforesaid arrangement, by accommodating the ink cartridge 60 into the accommodating space 61 of the carriage 12 and closing the lid 62, the ink supplying port 66 of the ink cartridge 60 is connected with the concave portion 71 of the ink cartridge connecting portion 70. As shown in FIG. 7, in the state that the ink cartridge 60 is accommodated in the carriage 12, the pressure member 73 is inserted into the inside of the filler accommodating section 93 from the pressure member inserting portion 101 by that the ink supplying port 66 is connected with the concave portion 71. At this time, since the tip portion of the pressure member 73 pushes the elastic film 105 into the inside of the ink cartridge 60, the facing portion 107 of the elastic film 105 is extended, thereby the holes 109 are enlarged and transformed to the holes 111 through which ink is able to pass. Accordingly, the ink permeating into the filler 95 passes through the holes 109 and flows into the ink flowing path 79 from the ink flowing port 81. As described earlier, ink flowing into the ink flowing path 79 futher flows into the ink flowing path 85 connected with the ink supplying section 42 of the recording head 10 through the ink flowing path 83.

Since the facing portion 107 of the elastic film 105 closely contacts with the tip portion 77 of the pressure member 73 when ink enters the ink flowing port 81 as described above, air never intervenes therebetween. Accordingly, no air is mixed with the ink which enters the ink flowing port 81 and bubbles are never generated inside the ink supplying section 42 and the cavity 40. Thus, pressurizing control of ink in the cavity 40 is able to be performed accurately and the recording head 10 discharges desired ink drops, thereby formation of excellent images becomes possible.

Further, in the state that the ink cartridge 60 is removed from the carriage 12, the facing portion 107 of the elastic film 105 which shields the ink supplying port 66 returns to its original shape including the holes 109 of the size that ink is unable to path therethrough. Accordingly, the leakage of ink from the holes 109 is prevented.

Figure 8:
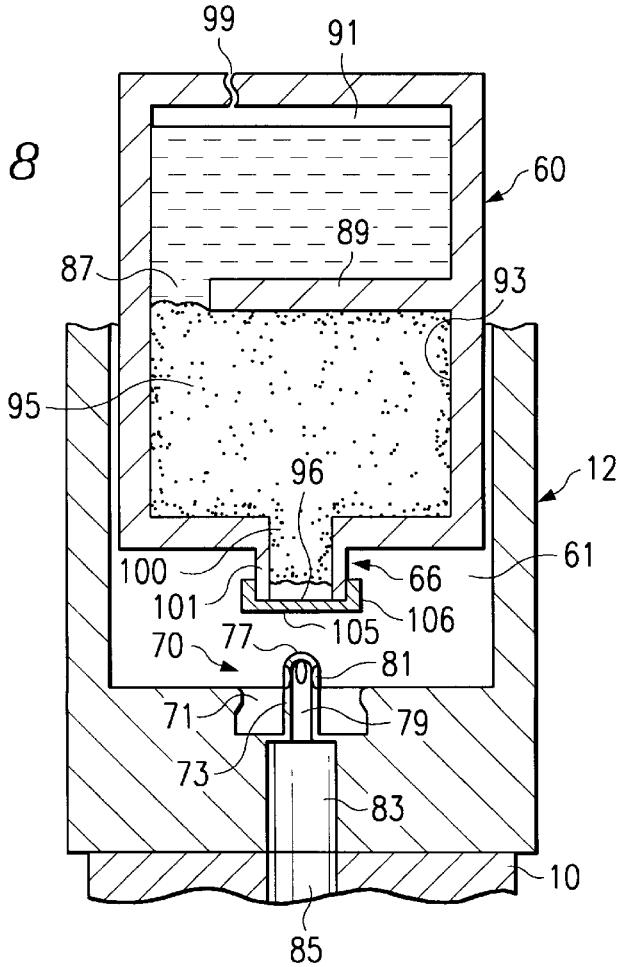
FIG. 8 is a cross sectional view showing a first modified embodiment of the ink cartridge connection mechanism.
Figure 9:
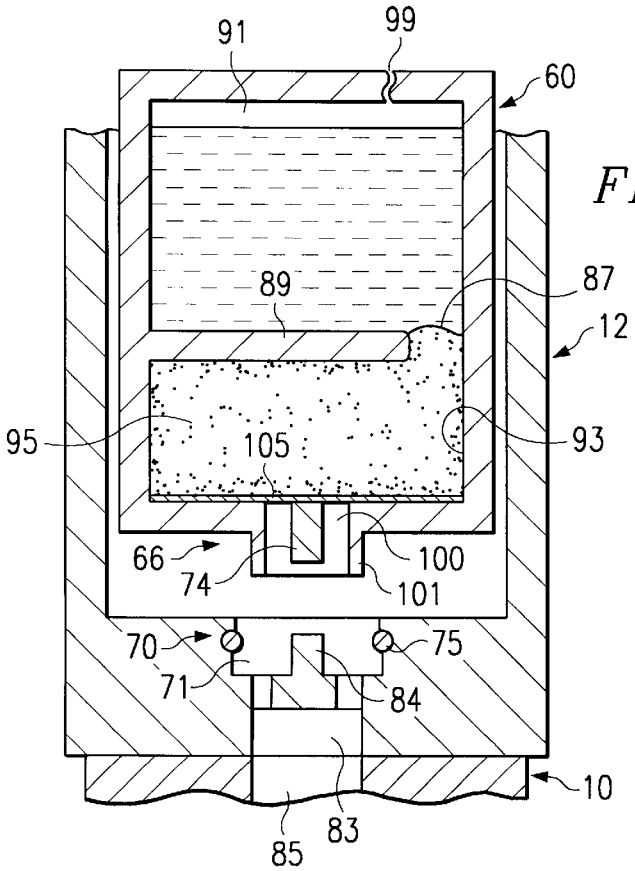
FIG. 9 is a cross sectional view showing a second modified embodiment of the ink cartridge connection mechanism.
Figure 10:
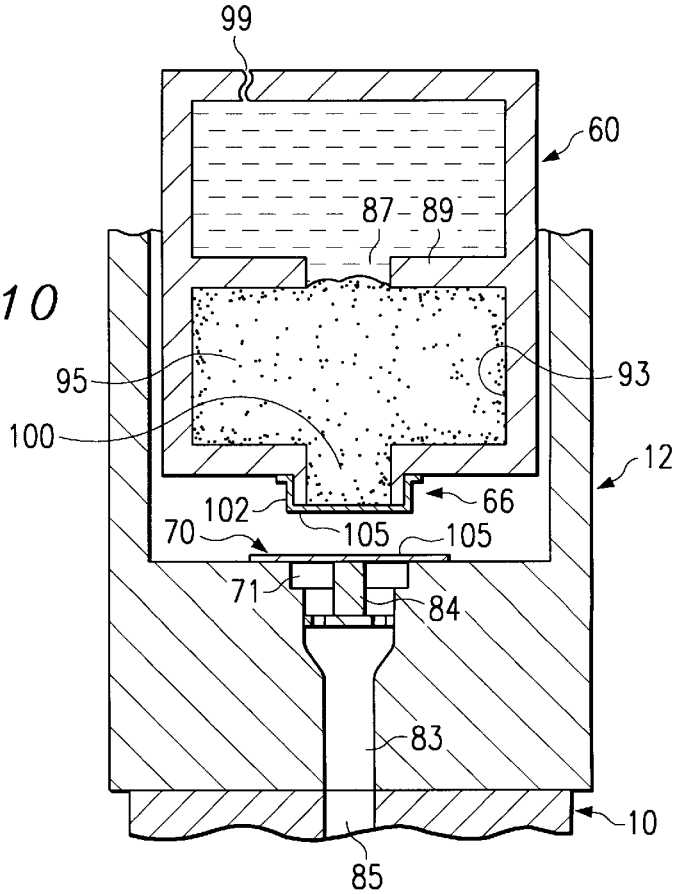
FIG. 10 is a cross sectional view showing a third modified embodiment of the ink cartridge connection mechanism.

FIGS. 8, 9 and 10 show modified embodiments 1, 2 and 3 of the ink cartridge connection mechanism 1 related to the present invention. Like elements with those of the ink cartridge 60 and the cartridge connecting portion 70 shown in FIG. 5 are given like marks.

The inside of an ink cartridge 60 shown in FIG. 8 is divided up and down by a partition plate 89, and the upper part is an ink accommodating section 91 and the lower part is a filler accommodating section 93. The ink accommodated in the ink accommodating section 91 penetrates a filler 95 accommodated in the filler accommodating section 93 via a connecting portion 87 which is not divided by a partition plate 89.

An elastic film 105 formed holes 109 is processed to a cap-shape and fitted and adhered to a pressure member inserting portion 101 of a ink supplying port 66. An edge portion 106 of the elastic film 105 acts as an O-shaped ring. Even in the case that a space 96 is formed between the elastic film 105 and the filler 95 as shown in the drawing, close contact among the filler 95, the elastic film 105 and a tip portion 77 with the insertion of a pressure member 73 into the filler accommodating section 93 from the ink supplying port 66 prevents mixture of air into the ink flowing from a flowing port 81 of the pressure member 73.

According to an ink cartridge 60 shown in FIG. 9, a cylindrical shaped pressure member 74 is attached to an elastic film 105 shielding an opening portion 100 on the outlet side of an ink supplying port 66. A convex member 84 is provided in an ink flowing path 83 of an ink cartridge connecting portion 70. In the state that the ink supplying port 66 is connected with a concave portion 71 of the ink cartridge connecting portion 70, the pressure member 74 contacts the convex member 84 and the elastic film 105 is pushed into the inside of a filler accommodating section 93 to extend a facing portion 107 and enlarge holes 109, thereby ink flows into the ink flowing path 83 through holes 111.

According to an ink cartridge 60 shown in FIG. 10, a connecting portion 87 is formed at the center part of a partition plate 89 which divides the inside of the cartridge up and down. An elastic film 105 is processed in a cap-shape and is fitted and adhered to a convex-shaped member inserting portion 102 of an ink supplying port 66. At the same time, another elastic film 105, which is also a processed sheet-like structure is stuck so as to shield a concave portion 71 of an ink cartridge connecting portion 70. A convex member 84 is provided in an ink flowing path 83 of the ink cartridge connecting portion 70. In the state that the ink supplying port 66 is connected with the concave portion 71 of the ink cartridge connecting portion 70, the convex member 84 pushes the elastic films 105 and 105 into the inside of a filler accommodating section 93 to extend respective holes 109 and 109 of the elastic films 105 and 105, thereby ink flows into the ink flowing path 83 through holes 111 and 111.

Figure 11:
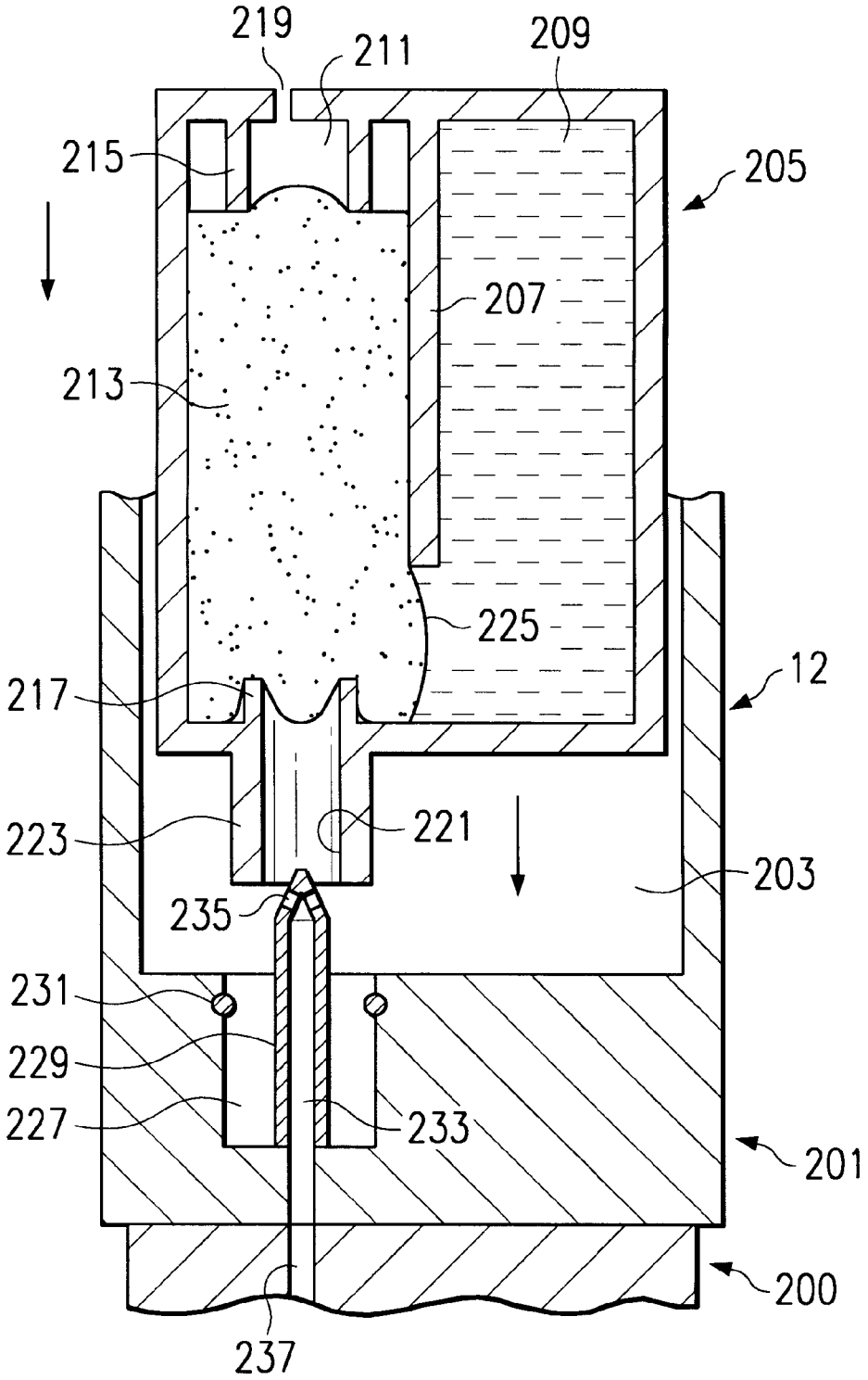
FIG. 11 (PRIOR ART)
FIG. 11 is a cross sectional view showing the known state that a conventional ink cartridge is connected with an ink cartridge connecting portion.

A description about experiments follows which has been performed concerning (i) ability of ink supply, (ii) mixture of bubbles, (iii) mixture of impurities and (iv) leakage of ink as to the aforesaid connection mechanism of the ink cartridge shown in FIG. 5 (the first embodiment), the modified embodiment 1 (shown in FIG. 8), the modified embodiment 2 (shown in FIG. 9), modified embodiment 3 (shown in FIG. 10) and the conventional ink cartridge 205 shown in FIG. 11). The ink used included 77.0% of water, 6.5% of polyhydric alcohol/diethylglycol, 6.5% of polyhydric alcohol ether/triethyleneglycol monobutyl ether and 4.5% of dye Baker BK-SP. The paper used was SF (super fine) sheets by Epson.

(i) Ability of Ink Supply

According to the experiment about ink supply ability, a supplying rate for ink accommodated in an ink cartridge to an the ink cartridge connecting portion was examined. The estimation is shown by o when the supplying rate is more than 65%, by Δ when the supplying rate is within the range of 30% to 65% and by χ when the supplying rate is less than 30%.

(ii) Mixture of Bubbles

According to the experiment about mixture of bubbles, an ink-removed dye was used, and the ink flowed into the ink flowing path of the ink cartridge connecting portion using a suction pump via a transparent tube to measure whether or not bubbles were present in the transparent tube. The estimation is shown by ⊙ when there is no bubble, by o when the present bubbles are up to three, by Δ when the present bubbles are up to five and by χ when the present bubbles are more than five. If the present bubbles are up to five, no problem occurs to the ink pressurizing control in the cavity.

(iii) Mixture of Impurities

According to the experiment about mixture of impurities, the ink removed dye was used, and the ink flowed into the ink flowing path of the ink cartridge connecting portion using a suction pump via a transparent tube after repeating ten times the operation of attaching and detaching the ink cartridge to and from the ink cartridge connecting portion, respectively, and then this sucked ink is filtered by a membrane filter and the pure water which washed the membrane filter is collected by the Coulter counter to measure whether or not impurities like dust and the like are present. The estimation is shown by © when there is no impurity, by o when the present impurities are up to three, by Δ when the present impurities are up to five and by χ when the present impurities are more than five. If the present impurities are up to three, no problem occurs in a printing operation.

(iv) Leakage of Ink

According to the experiment about leakage of ink, the ink cartridge which has been connected with the ink cartridge connecting portion only once and removed thereafter is dropped from one meter height to measure whether or not the ink scatters from the ink supplying port. The estimation is shown by o when the scattered ink drops are up to five, by Δ when the scattered ink drops are not less than six and by χ when the scattered ink drops are not less than ten. The results of the aforesaid experiments (i) to (iv) are shown in the following table 1.

| Experiment | Embodiment 1 | Modified Embodiment 1 | Modified Embodiment 2 | Modified Embodiment 3 | Conventio-nal Example |
|---|---|---|---|---|---|
| (i) | ○ | ○ | ○ | ○ | ○ |
| (ii) | ⊙ | ○ | Δ | ⊙ | x |
| (iii) | ○ | ○ | ○ | ⊙ | Δ |
| (iv) | ○ | ○ | Δ | ⊙ | x |

As apparent from the above table 1, all of the embodiment 1 and the modified embodiments 1 to 3 never caused practical problems. Especially, the modified embodiment 3 shows the excellent result. This seems to be because, since the elastic films are provided on the ink supplying port 66 of the ink cartridge 60 and on the concave portion 71 of the ink cartridge connecting portion 70, the shielding ability is effected more remarkably. The conventional example was unable to obtain a satisfactory result by the experiments (ii) to (iv) except the experiment (i) and found out to cause problems in printing operation and the like.

Although the present invention has been fully described by way of examples with reference to the accompanying drawings, it is to be noted that various changes and modifications will be apparent to those skilled in the art. Therefore, unless such changes and modifications otherwise depart from the scope of the present cinvention, they should be construed as being included herein.

Obviously, many modifications and variation of the present invention are possible in light of the above teachings. It is therefore to be understood that within the scope of the appended claims, the invention may be practiced other than as specifically described.

What is claimed is:

1. An ink cartridge accommodating ink, comprising:

an ink supplying port which supplies the ink outside the ink cartridge; and an elastic, deformable film which is arranged at a position to obstruct said ink supplying port and which has a plurality of small holes, wherein said small holes become larger when said film is deformed.

2. An ink cartridge in accordance with claim 1, wherein said film is disposed within said ink cartridge and prior to said ink supplying port.

3. An ink cartridge in accordance with claim 1, wherein said film is disposed outside of said ink supplying port.

4. An ink cartridge in accordance with claim 1, further comprising a filler which is disposed in said cartridge.

5. An ink cartridge in accordance with claim 1, wherein at least a portion of said film is rubber.

6. An ink cartridge in accordance with claim 1, wherein said film is disposed inside of said ink supplying port.

7. A connection mechanism between an ink cartridge accommodating portion and an ink cartridge accommodating ink therein, the connection mechanism comprising:

an ink supplying port formed on the ink cartridge;

a deformable film provided at a position for covering said ink supplying port, where said film is elastic and further has a plurality of small holes formed therein; and a pressure portion which deforms said film when said ink cartridge is engaged by said ink cartridge accommodating portion, wherein said small holes become larger when said film is deformed.

8. A connection mechanism in accordance with claim 7, wherein said film is disposed within said ink cartridge and prior to said ink supplying port.

9. A connection mechanism in accordance with claim 7, wherein said film is disposed outside of said ink supplying port.

10. A connection mechanism in accordance with claim 7, further comprising a filler positioned within the cartridge.

11. A connection mechanism in accordance with claim 7, further comprising a second deformable film to cover said pressure portion, where said second film is elastic and further has a plurality of holes formed therein.

12. A connection mechanism in accordance with claim 7, wherein said pressure portion is convexly curved.

13. A connection mechanism in accordance with claim 7, wherein said pressure portion has an ink flow path.

14. A connection mechanism in accordance with claim 7, wherein at least a portion of said elastic film is rubber.

15. An ink cartridge in accordance with claim 7, wherein said film is disposed inside of said ink supplying port.

16. A connection mechanism between an ink cartridge accommodating portion and an ink cartridge accommodating ink therein, the connection mechanism comprising:

an ink supplying port extending between an interior of said ink cartridge to an exterior surface thereof;

an elastic, deformable film provided at a position for covering said ink supplying port, wherein said film has a plurality of small holes formed therein; and a protrusion which deforms said film when said ink cartridge accommodating portion properly engages said ink cartridge, wherein said protrusion includes at least one inlet and a fluid path, and said at least one inlet is in fluid communication with said fluid path, wherein when said film is in a non-deformed state, said small holes do not allow transmission of ink from the ink cartridge therethrough, and when said film is in a sufficiently deformed state, said small holes become of sufficient size to readily allow transmission of ink from the ink cartridge therethrough, and wherein in said sufficiently deformed state, said at least one inlet is in fluid communication with an interior of said ink cartridge.

17. A connection mechanism in accordance with claim 16, wherein said film is disposed within said ink cartridge and prior to said ink supplying port.

18. A connection mechanism in accordance with claim 16, wherein said film is disposed outside of said ink supplying port.

19. An ink cartridge in accordance with claim 16, wherein said film is disposed inside of said ink supplying port.

* * * * *